US005540422A

United States Patent [19]

St. John et al.

[11] Patent Number: 5,540,422

[45] Date of Patent: Jul. 30, 1996

[54] STACKER-BUNDLER TRANSFER APPARATUS

[75] Inventors: John St. John, Lake Arrowhead; Jerry L. Bates, Redlands, both of Calif.

[73] Assignee: Baldwin Technology Corporation, Rosemont, Ill.

[21] Appl. No.: 326,129

[22] Filed: Oct. 24, 1994

[51] Int. Cl.[6] ..... B42F 1/00; B65G 57/00

[52] U.S. Cl. ..... 270/52.18; 270/52.14; 414/789.9

[58] Field of Search ..... 270/53, 54, 58; 414/790, 790.1, 789.9

[56] References Cited

U.S. PATENT DOCUMENTS

| | | | |
|---|---|---|---|
| 1,756,920 | 4/1930 | Gollnick et al. . | |
| 2,933,314 | 4/1960 | Stobb . | |
| 3,164,270 | 1/1965 | Kinker . | |
| 3,501,139 | 3/1970 | Stobb . | |
| 3,635,463 | 1/1972 | Stobb . | |
| 3,739,924 | 6/1973 | Stobb | 414/789.9 |
| 3,743,078 | 7/1973 | Pittoreau . | |
| 3,811,549 | 5/1974 | Preisig . | |
| 3,825,134 | 7/1974 | Stobb | 414/786 |
| 3,982,749 | 9/1976 | Stobb . | |
| 4,049,259 | 9/1977 | Ventz . | |
| 4,172,531 | 10/1979 | Muller . | |
| 4,221,373 | 9/1980 | Muller . | |
| 4,313,600 | 2/1982 | Mosberger . | |
| 4,361,318 | 11/1982 | Stobb . | |
| 4,413,941 | 11/1983 | Kollmann | 414/789.9 X |
| 4,463,940 | 7/1984 | Mock | 270/54 |
| 4,500,245 | 2/1985 | Madewell | 414/108 |
| 4,618,054 | 10/1986 | Muller . | |
| 4,723,883 | 2/1988 | Smith | 414/789.9 X |
| 4,772,003 | 9/1988 | Nobuta et al. | 414/789.9 X |
| 4,984,677 | 1/1991 | Prakken . | |
| 5,022,813 | 6/1991 | Smith | 414/790 |
| 5,133,543 | 7/1992 | Eitel et al. . | |
| 5,279,536 | 1/1994 | Abreu | 414/790 X |
| 5,282,716 | 2/1994 | Prim et al. | 414/790.3 |

FOREIGN PATENT DOCUMENTS

| | | |
|---|---|---|
| 769133 | 2/1957 | United Kingdom . |

*Primary Examiner*—John E. Ryznic
*Attorney, Agent, or Firm*—Richard S. Roberts

[57] ABSTRACT

An improved bundle transfer apparatus for sheet material in signature form is provided. The apparatus includes a frame having rails on which a bundle transfer vehicle is mounted. The bundle transfer vehicle has a platform which is movable to a position under the signatures and a means for raising the platform and the signatures. The signatures on the bundle transfer vehicle are transferred to an end of the table where it is compressed and tied.

27 Claims, 8 Drawing Sheets

STACKER-BUNDLER TRANSFER APPARATUS

BACKGROUND OF THE INVENTION

1. Field of The Invention The present invention relates to an improved apparatus for stacking, transferring and bundling sheet material in signature form as received from a conveying device.

2. Description of the Prior Art

It is known in the graphic arts that sheet materials such as newspapers, books, printed cartons and the like emerge from a printing operation in a serial, partially overlapping shingled or signature form. In the conventional arrangement, a stream of sheets, for example in the form of newspapers, is collected on a conveyor which receives the sheets from the printing press, cutter or folder and which moves the sheets to a stacker. Stackers are commonly employed in the printing industry for collecting and aligning the signatures. The stacker receives the sheets in serial form from the conveyor and forms a neat aligned stack which is easy to bundle together for removal and transportation. Many stacking arrangements are known in the art as exemplified by U.S. Pat. Nos. 2,933,314; 4,361,318; 2,933,314 and 4,463,940 which are incorporated herein by reference. U.S. Pat. No. 4,463,940 describes a commonly used stacker having an upswept arcuate array of rollers sequentially engaging signatures with crusher rollers and opposed endless timing belts which are compression mounted by the series of rollers. U.S. patent application Ser. 08/009,774 shows an improved stacker which is preferred for use by this invention and such is incorporated herein by reference. Folded, overlapped signatures exiting from the end of a printing press are stream conveyed along a horizontal course leading to the stacker. The stacker changes the stream path from horizontal to vertical. The signatures are initially crushed between rollers to compact them and to exhaust entrapped air. The stream of shingled signatures is thereafter passed between top and bottom conveyors which form a compression zone of the stacker and which maintains the signatures fully compressed during their transition from a horizontal stream to a vertical stream. Upon leaving the compression zone the stream of signatures has an upward thrust. They are then stopped, engage a receiver and form a growing, stack of the signatures on a horizontal conveyor belt. The stack takes the shape of an ever enlarging right rectangular parallelepiped. The horizontally stacked product is then bundled, that is, compressed and/or tied and placed onto a skid, pallet or into a box for shipment. Bundling apparatus are also well known in the art. In this regard, see U.S. Pat. Nos. 3,982,749; 3,825,134; 3,739,924 and 3,635,463. Bundlers compress the stack of signatures to remove any remaining compressed air and wrap a tight band of strapping material around the stacks for boxing or palletizing.

It has been a problem in the art to provide an efficient and effective means of transferring stacks of signatures from the horizontal exit conveyor of the stacker to the bundling station. While the stacking and bundling operations in and of themselves are routinely automated, the transfer from the stacker to the bundler has been a labor intensive task. In the past, a stacked pile of paper materials such as printed signatures has been assembled on flat tables after processing by the stacker conveyors. End boards, or pieces of plywood the same size as the signatures are placed at either end of the formed bundle and then the signatures and end boards are moved by hand to another portion of the table for compression and bundling. Such an operation has many disadvantages since such hand movement of the stacked signature requires considerable strength and effort and movement of the stack along the table tends to abrade and damage the lower edges of the signatures which are in contact with the table. Additionally, there is a disruption of signature alignment into an uncompressed group of signatures. One solution is embodied in the commercially available Baldwin Stobb DH series equipment. U.S. Pat. Nos. 4,723,883 and 5,022,813 have suggested other possible solutions which include a stacker to bundler shuttling apparatus. The equipment is in the form of a table having pivotable tracks which carries a platform on a rolling shuttle for picking up and transferring a collection of signatures from the stacker to a position on the table for compression and bundling. While this equipment considerably alleviates the effort required to move a stack from one position to another, it has rather severe drawbacks. The means for lifting the signatures is provided by pivoting the tracks on which the wheels of the shuttle are engaged. These systems are disadvantageous since a large force and a substantial mechanism are necessary to raise not only the collection of signatures, but also the platform, platform truck and the track. Furthermore, as the length of the machine is extended, the difference in the amount of lift provided near the pivot end as opposed to the opposite end begins to become extreme. Also, the structural integrity of the track with possible binding due to bending moments and other forces comes into question and requires special care and added costs. The present invention improves on the forgoing apparatus whereby a two part bundle transfer vehicle is provided which eliminates the need for a pivoted track. Rails can be provided that essentially are structural members of the basic frame construction. As a result, much less force is needed to raise the stack. In addition, since weight is much less of a consideration, much sturdier rails and transfer vehicles can be used. Special care against track binding is eliminated. In a most preferred embodiment, a bundle transfer vehicle comprises a two part construction. It has a first rolling element portion comprising wheels or other friction reducing means, rolls or otherwise traverses horizontally back and forth along a stationary horizontal rail. It further has a second elevator portion which rides on the first portion and may be raised and lowered under the stack of signatures. This arrangement provides significant advantages. The length of travel is of very little concern, especially since the rails are structural members. All motion is level motion, thus easing powered bundle transfer vehicle motion. Lifting motion is uniform, that is straight up, regardless of the length of the rail or the position of the apparatus along the length of the rail. It is easier to install multiple streams since one can raise or lower the signatures in a stream independently of the rails. In addition, the cost of manufacture is much less. These and other features, advantages and improvements will be in part discussed and in part apparent to one skilled in the art upon a consideration of the detailed description of the preferred embodiment and the accompanying drawings.

SUMMARY OF THE INVENTION

The invention provides apparatus for transferring sheet material in signature form including a horizontal frame and a conveyor mounted longitudinally in the frame at an upper portion of a rearward section thereof and which extends a part of the distance along the length of the frame. The conveyor has a plurality of horizontally disposed conveyor belts which are spaced apart to form gaps therebetween and which receive the sheet material in the form of a stack of signatures on top of the belts. The apparatus further has one or more stationary rails mounted in the frame extending about parallel to the conveyor belts. The rails extend from the rearward section of the frame to a forward section of the frame. The apparatus includes a bundle transfer vehicle having a first rolling element portion comprising a framework and a plurality of friction reducing means mounted on the framework. The friction reducing means engages and rides horizontally on the rails. The vehicle has a second portion connected by raising and lowering means to the first portion comprising a plurality of connected, upright support segments. The raising and lowering means mounted on the first portion are capable of raising and lowering the support segments relative to the first portion and its friction reducing means. The support segments are interdigitated and substantially aligned with the gaps between the conveyor belts. The segments are at a first position below the conveyor belts when the support segments are lowered by the raising and lowering means and at a second position above the conveyor belts when the support segments are raised by the raising and lowering means. At the second position the support segments are capable of lifting and holding the stacked sheet material in signature form away from the conveyor. Means are provided for biasing the bundle transfer vehicle for movement in at least one direction along the rails.

DETAILED DESCRIPTION OF THE PREFERRED EMBODIMENT

Figure 1:
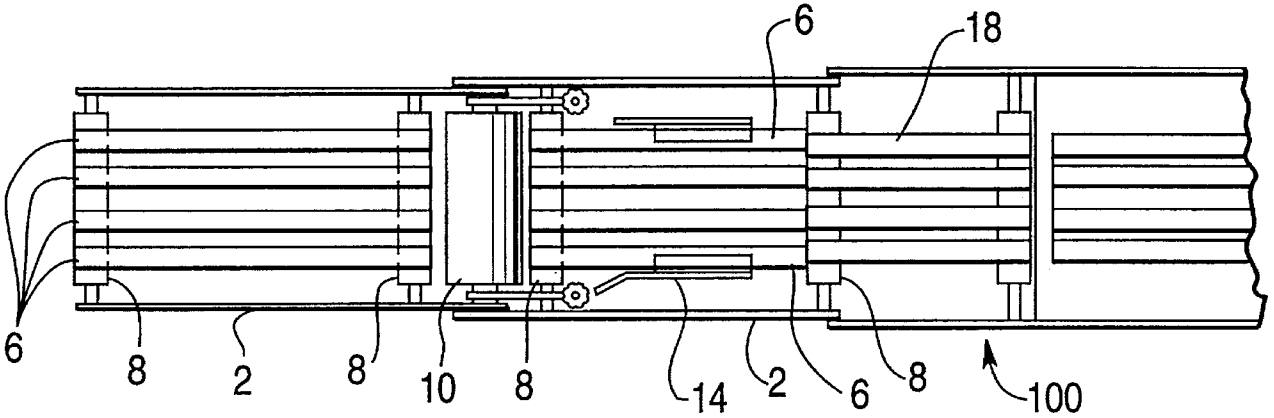
Fig. 1 PRIOR ART
FIG. 1 shows a top overview in schematic form of the layout of a prior art conveyor, crusher, jogger and stacker arrangement.
Figure 2:
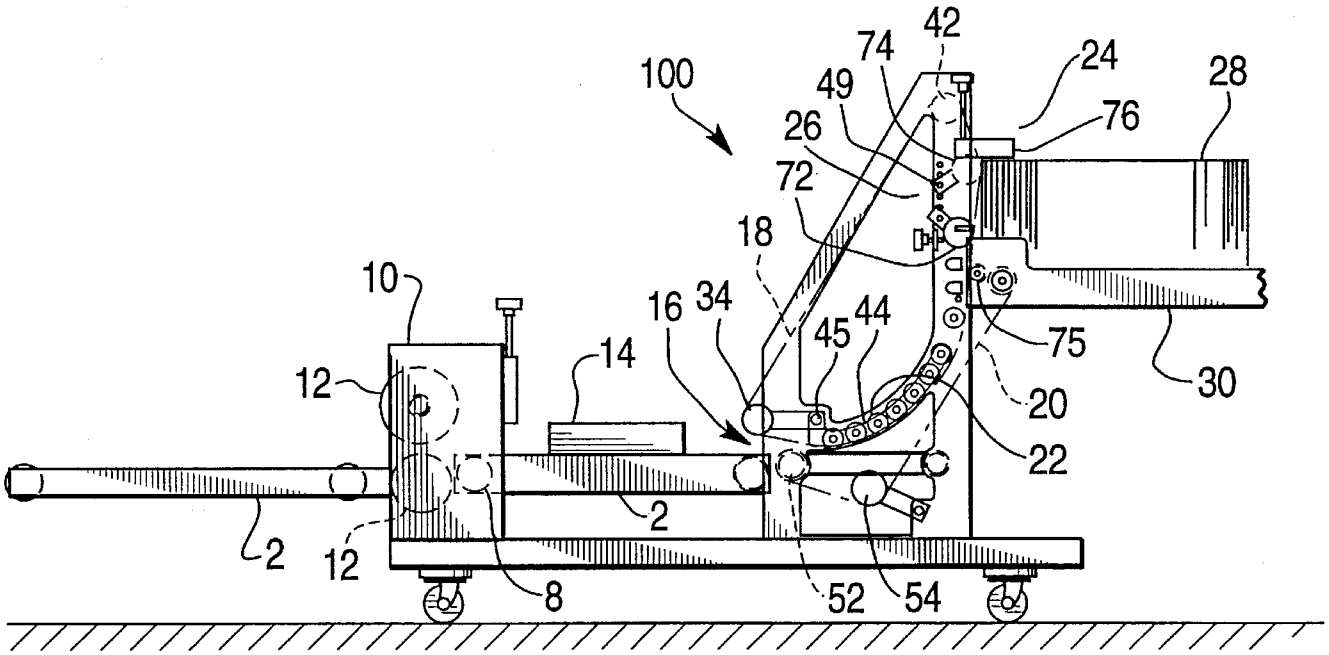
Fig. 2 PRIOR ART
FIG. 2 shows a side overview in schematic form of the layout of a prior art conveyor, crusher, jogger and stacker arrangement.

Referring to FIGS. 1 and 2, one respectively sees a top and side view of a stacker 100 together with attendant conveyors. A continuous stream of signatures flows along conveyor 2 from the end of a printing press, folding machine or cutting machine which are not shown. Single or multiple streams of signatures may be accommodated. Conveyor 2 is of conventional construction and includes supported conveyor belts 6 and rollers 8 as best seen in FIG. 1. Horizontal conveyor 2 is composed of several separate endless belts 6, spaced laterally apart. These belts move at the same speed and convey the signatures in a shingled stream partially overlapping form. Preferably disposed in-line with conveyor 2 is a crusher station 10. Crusher station 10 comprises two opposed crusher rollers 12. The upper roller is vertically adjustable relative to its lower counterpart roller. The crusher presses on the approaching shingled signatures to exhaust air and flatten them for their transition from horizontal to vertical travel. Optionally, the crushed signatures may then pass through a jogging station 14 to align the signatures edgewise and move them forward. In operation, folded, overlapped signatures exiting from the end of the press are stream transferred horizontally on conveyor 2, crushed at crusher station 10, to exhaust air and compact them, and jogged at jogger station 14 to align them prior to entry into stacker 100.

Stacker 100 has an input end 16, sets of opposing, floating, compressive, conveyor timing belts 18 and 20, an upwardly arcing set of rollers 22 and a receiver station 24 at output end 26. Upon introduction into the input end 16, the signatures enter a compression zone at the nip of the two conveyors 18 and 20 which maintain the signatures fully compressed and aligned during their transition from a horizontal to a vertical position. The timing belts travel a continuous path, part of which is adjacent to the upwardly sloped roller arc 22. The arc path is approximately ninety degrees. The conveyor 20, while not directly contiguous to rollers 22 indirectly applies compression against the conveyor 18 and the rollers 22 via the signatures which are conveyed between floating conveyors 18 and 20. This system creates a suitable compression zone for the controlled passage of the overlapped signatures through transition from horizontal to vertical prior to actual stacking. After leaving the compression zone, the stream of signatures is provided with an upward thrust along arcuate set of rollers 22 and is stopped and brought into a vertical stacking mode at receiver station 26 where it is formed into a stack which takes the shape of an ever enlarging right rectangular parallelepiped. As the signatures continue into and out of the stacker conveyors they are received and stacked vertically as shown at 28 on exit table 30 which is described more fully hereinafter. The stacks are then moved by a bundle transfer apparatus to a downstream position for further processing. As shown in FIG. 2, stacker 100 comprises an outer framework which supports and connects the other operating parts of the device. An upper conveyor system comprises upper conveyor belts 18, idler pulley take up assemblies 34, upswept arcuate idler rollers 22, adjustment pulleys on a shaft 49 and drive shaft pulley assembly 42. On the far side of the stacker, each of the rollers 22 are rotatably mounted within the outer framework. However, on the near side of the stacker, each of the rollers 22 is preferably rotatably mounted within an inner framework 44. Hole 45 is provided for the mounting of a shaft which allows the pivoting of take up pulley assemblies 34 on said shaft. The lower conveyor system comprises conveyor belts 20, drive shaft pulley assemblies including pulleys 52 and take up pulley assemblies 54. Both upper and lower conveyor systems 18 and 20 preferably comprise five endless timing belts, laterally spaced a few inches apart from one another. They may be tensioned by means of pulleys as desired. The diameter of each conveyor roller may be made suitable to design by the skilled artisan.

The leading edge of each signature passes by and is guided by roller 72 and then roller 74 as shown in FIG. 2. The leading edge of each signature then strikes stripper fingers 76 and simultaneously the trailing edge is kicked by kicker 75 thus maintaining space for subsequent signature leading edges. Each signature is displaced sideways from the stripper fingers 76 by a following signature. Then the signatures have essentially completed the transition from a horizontal position to a vertical position. The signature is subsequently engaged by delivery table conveyor belts 104 as shown in FIG. 3 while in a vertically aligned position.

Figure 3:
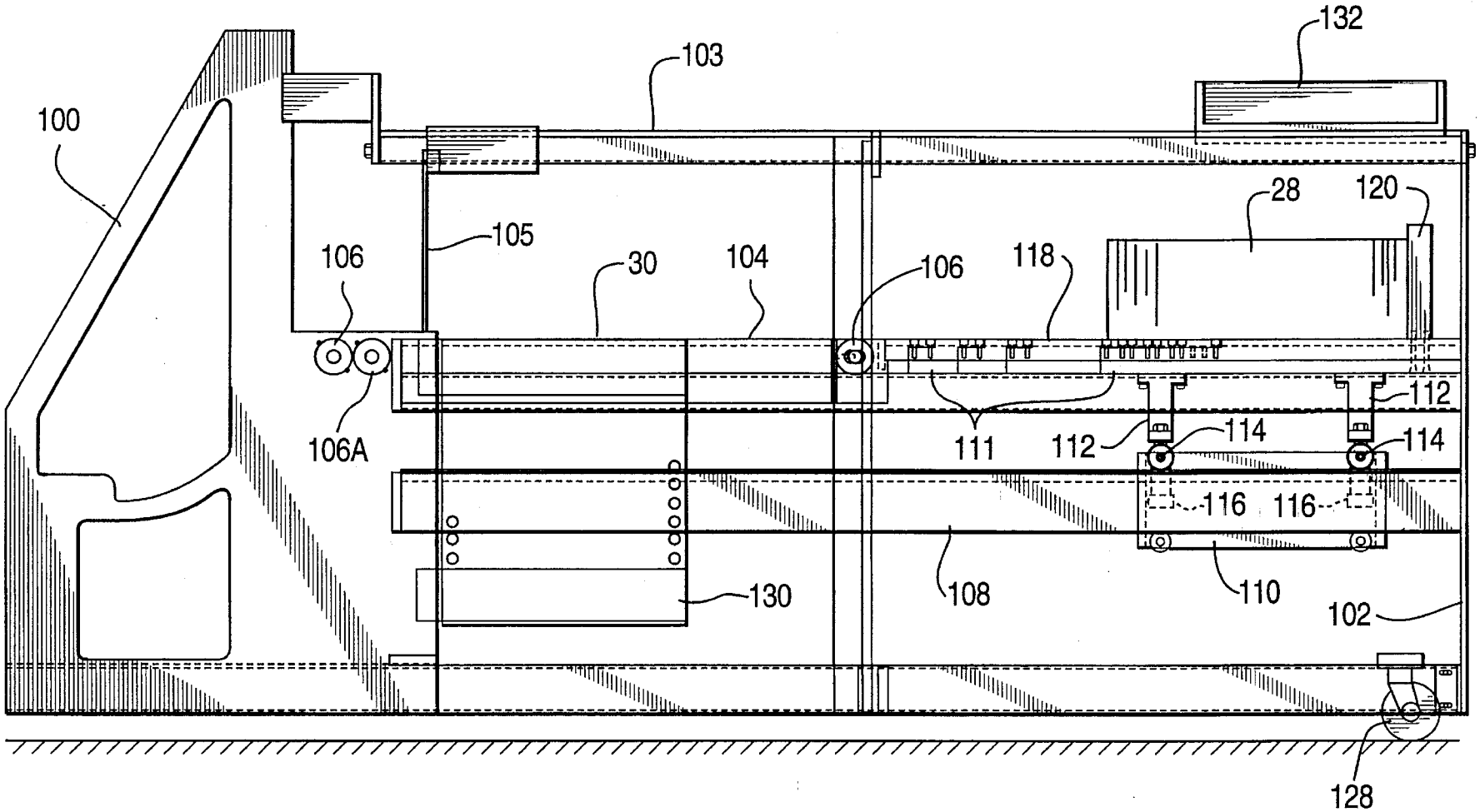
FIG. 3 shows a side sectional view of the overall bundle transfer apparatus of the invention which cooperates with a stacker.
Figure 4:
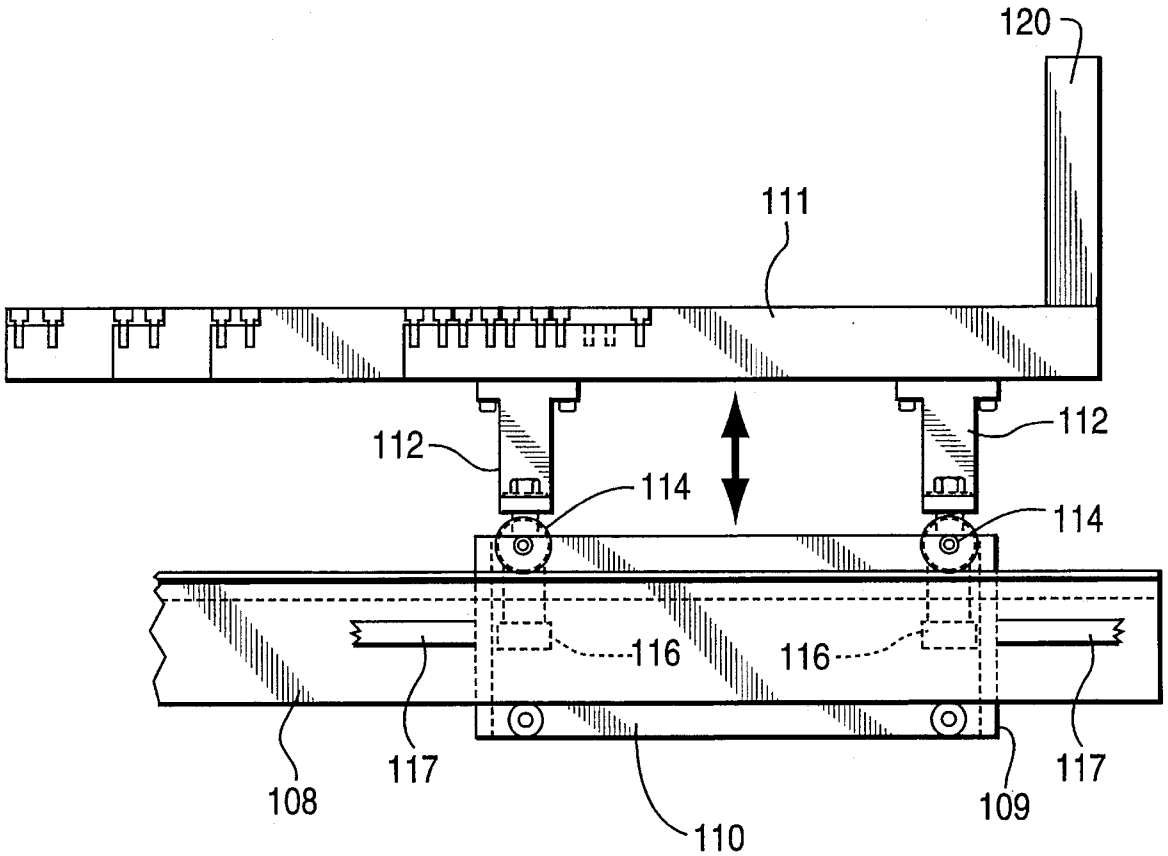
FIG. 4 shows an enlarged side sectional view of the bundle transfer vehicle part of the overall apparatus.
Figure 6:
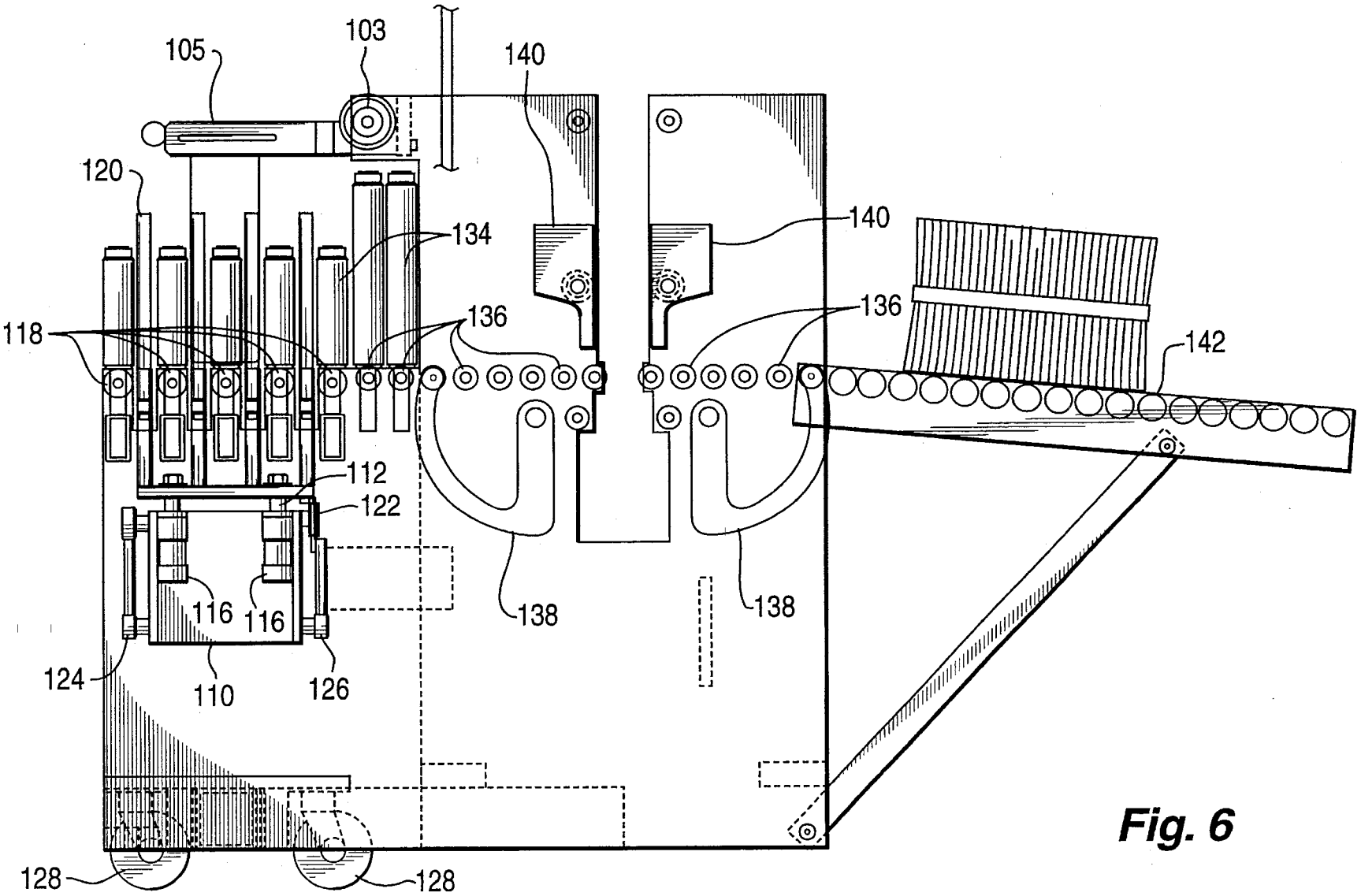
FIG. 6 shows an end view of a preferred embodiment of the bundle transfer apparatus including a powered bundling station.

FIGS. 3 and 4 show a side sectional view of the apparatus of this invention which cooperates with the stacker. The apparatus moves an assembled collection of substantially on-edge, vertically aligned signatures away from exit table 30 for subsequent compression and strapping of the signatures for shipment or storage. The apparatus comprises a frame 102 which is attached to stacker 100 by suitable means. On the level of exit table 30 is a conveyor mounted longitudinally in the frame at its rearward section and which extends a part of the distance along the length of the frame. The conveyor comprises a series of horizontal conveyor belts 104 which are spaced apart to form gaps between them. The conveyor belts, driven by idler pulleys 106 and powered pulleys 106A convey the product away from exit table 30. The conveyors receive the sheet material in the form of an ever growing stack of vertically aligned signatures that grows horizontally in the direction of the belts. Along the top of the frame 102 is a structural assembly or rail 103 along which rides a rigid, pivotable bar or product support assembly 105 which is best seen in FIG. 6. The product support assembly provides a slight stabilizing force for the leading end of the growing stack of signatures and maintains the signatures in a vertical position. The product support provides a force on the stack in the opposite direction of the movement of the stack and moves with the leading face of the stack as it grows. Also on the frame 102 are rigidly mounted stationary rails 108 mounted essentially horizontally in the frame, which extend parallel to and at a level lower than the top of the conveyor belts 104. The rails extend from the rearward section of the frame where the rails underlie the conveyor to a forward section of the frame. The apparatus also comprises a two part bundle transfer vehicle assembly 110. A first part of the bundle transfer vehicle comprises a rolling element portion 109. The rolling element portion comprises a framework having friction reducing means 114 which are preferably wheels. Other useful friction reducing means include Thompson rod type bearings or other rolling means. Such means reduce resistance to motion in a direction parallel to the rails. In the most preferred embodiment the friction reducing means are wheels which ride on rails 108. The second part of the bundle transfer vehicle is a raisable part which raises and lower the signatures. It comprises a series of upright support segments 112 which preferably comprise a series of upwardly projecting elements on the top of which are situated a series of horizontal support members 111 which are interdigitated and align with the gaps between the conveyor belts. The elevator part also includes means 116 for raising and lowering the support segments relative to the rolling element portion. These are mounted on the rolling element portion and attach to the support segments. In the preferred embodiment these raising and lowering means are air cylinders, but the invention is not limited thereto. In use, the support segments 112 are lowered to a first position by the air cylinders and placed by the rolling element portion at the rear of frame 102 below the conveyor belts. The support segments are then raised by the air cylinders to a second position above the conveyor belts. Thus when at the second position, the support segments lift and hold the stacked sheet material in signature form above the conveyor belts. The arrow indicates the up and down motion of the support segments. The bundle transfer vehicle assembly 110 then moves the support segments and signatures in a direction along the rails until they are at a forward location in the frame 102. The air cylinders then retract and lower the support segments, depositing the signatures on a table or rollers 118 at the forward location on the frame as shown in FIG. 3. Table 118 comprises a series of horizontally disposed parallel rollers which are aligned with the ends of conveyors belts 104. These allow the passage of the support segments between them since they are also interdigitated and aligned with the gaps between the rollers. Also shown in FIG. 4 are drive means 117 which may provide for the powered movement of bundle transfer vehicle assembly 110 along rails 108. Any means which can direct the powered motion of the bundle transfer vehicle 110 back and forth along rails 108 can be used. Such include a driven timing belt and a clamping device which causes the bundle transfer vehicle to grip the belt, a screw drive, air cylinders or a motor mounted on the bundle transfer vehicle which engages rails 108. Such may include means to connect or disconnect the power transmission by means of a clutch or other similar device such that when the clutch is engaged, the bundle transfer vehicle may be driven and when the clutch is disengaged, the bundle transfer vehicle is free to move along the rails such as by the application of hand pressure. Various bundle transfer vehicle powering arrangements are shown in FIGS. 7–10.

Figure 5:
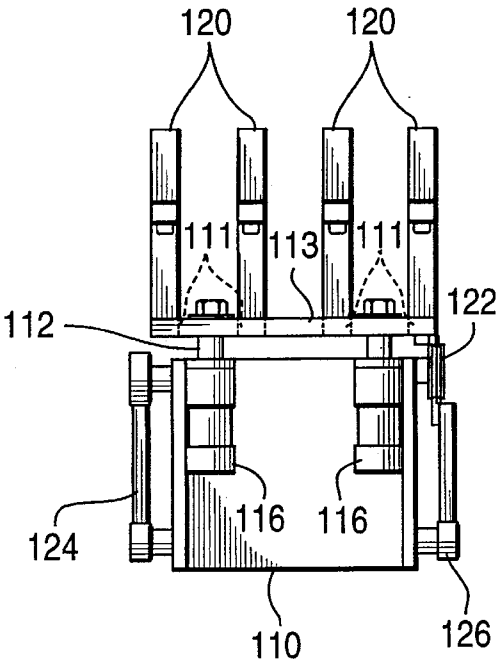
FIG. 5 shows an end view of the bundle transfer vehicle.

FIG. 5 shows an end view of the bundle transfer vehicle of the inventive apparatus. Shown are backstop 120, the ends of horizontal support members 111, a backplate 113 for the horizontal support members, and air cylinders 116. Also shown is a guide means preferably comprising v-roller 122 and cam followers 124 and 126 which stabilizes the bundle transfer vehicle and keeps it aligned along the rails 108 and which provide rolling inertia. Backstop 120 is attached at an end of the bundle transfer vehicle as shown and extends above the level of table 118 as shown in FIG. 3. When the bundle transfer vehicle is at its rearmost position and the signatures are moved forward by the conveyor belts 104, product support 105 supports the stack of signatures until it reaches backstop 120. Backstop 120 then assumes support for the growing stack of vertical signatures while the product support is recycled to the rearmost portion of the machine. The backstop continues to support the signatures while they are moved from the rearward to the forward positions of frame 102 by the bundle transfer vehicle.

FIG. 6 shows an end view of a preferred embodiment of the bundle transfer apparatus including a powered bundling and strapping station. After the stack of signatures is transferred onto roller table 118, it is moved by powered horizontal rollers 136 and guided by vertical idler rollers 134 to a bundling station where it is aligned in place by pivoting clamps 138, compressed by air cylinder rams 140 and strapped with suitable automatic strapping machines. Optionally rollers 118 and 134 may also be powered. The strapping is preferably applied by a fully automatic strapping head such as is commercially available from Dynaric or Signode and are well known to those skilled in the art. The compressed and strapped stack then leaves by means of the powered rollers onto exit conveyor 142. The entire bundle transfer apparatus may be mounted on caster wheels 128 so that it may be moved into and out of cooperation with an upstream folder, cutter and/or press. The operation of the bundle transfer apparatus is controlled by a suitable programmable logic controller which is located in a control box 130 which may further contain a transformer and motor starter, all of which are well known in the art. These provide the power and controls to direct the back and forth motion of the bundle transfer vehicle, the raising and lowering motion of the raising and lowering means on the bundle transfer vehicle, the conveyor belts, the product support, the powered rollers, powered clamps, air cylinder rams and strapping head and all other elements of the apparatus.

FIG. 3 shows a switchbox 132 containing suitable controls and switches for the control box.

Figure 7:
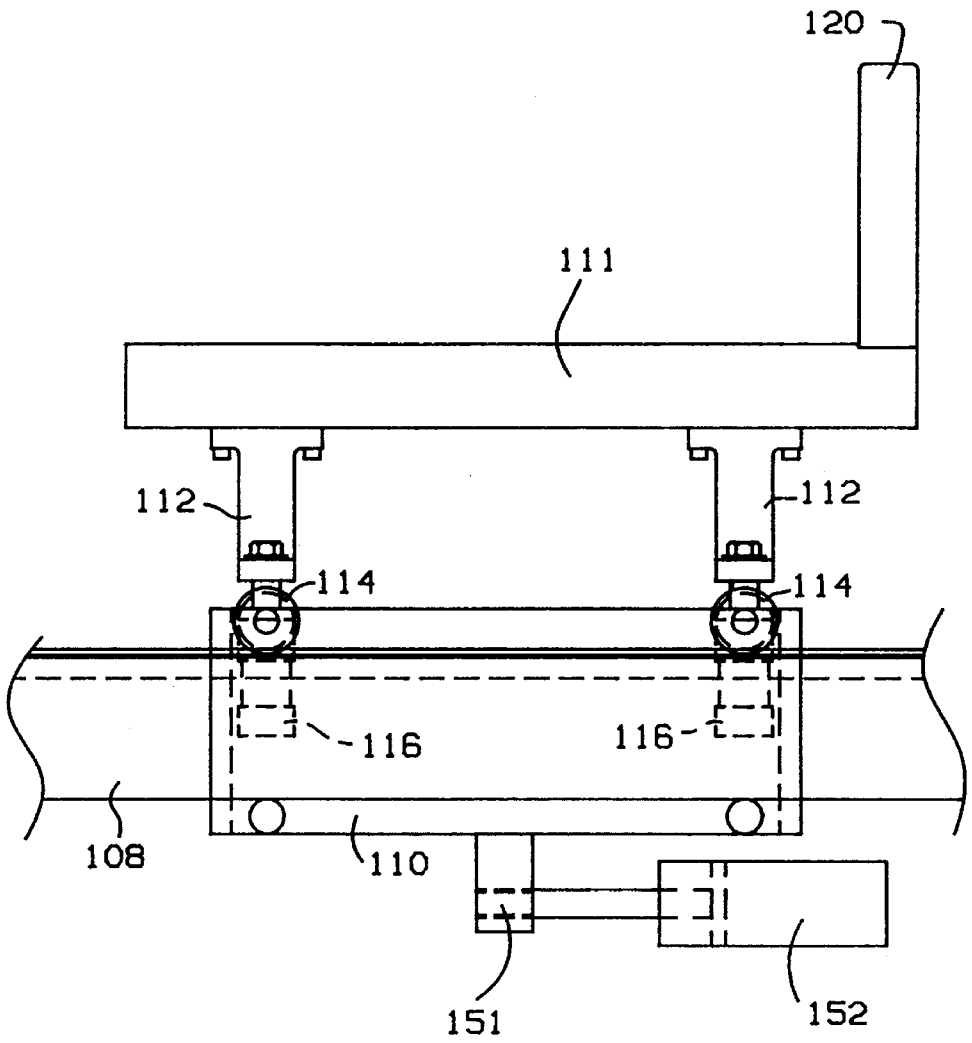
FIG. 7 shows an air cylinder arrangement for powering the bundle transfer vehicle.

FIG. 7 shows one arrangement for powering the motion of the bundle transfer vehicle along the rails. Air cylinder 152 provides power to move the bundle transfer vehicle 110 through a connection device 151. Connection device 151 may include a clutch device to connect and disconnect the air cylinder from the bundle transfer vehicle such that when the clutch is engaged the bundle transfer vehicle may be driven in either direction by the air cylinder. When the clutch is disengaged, the bundle transfer vehicle is free to move along the rails by the application of hand pressure by an operator.

Figure 8:
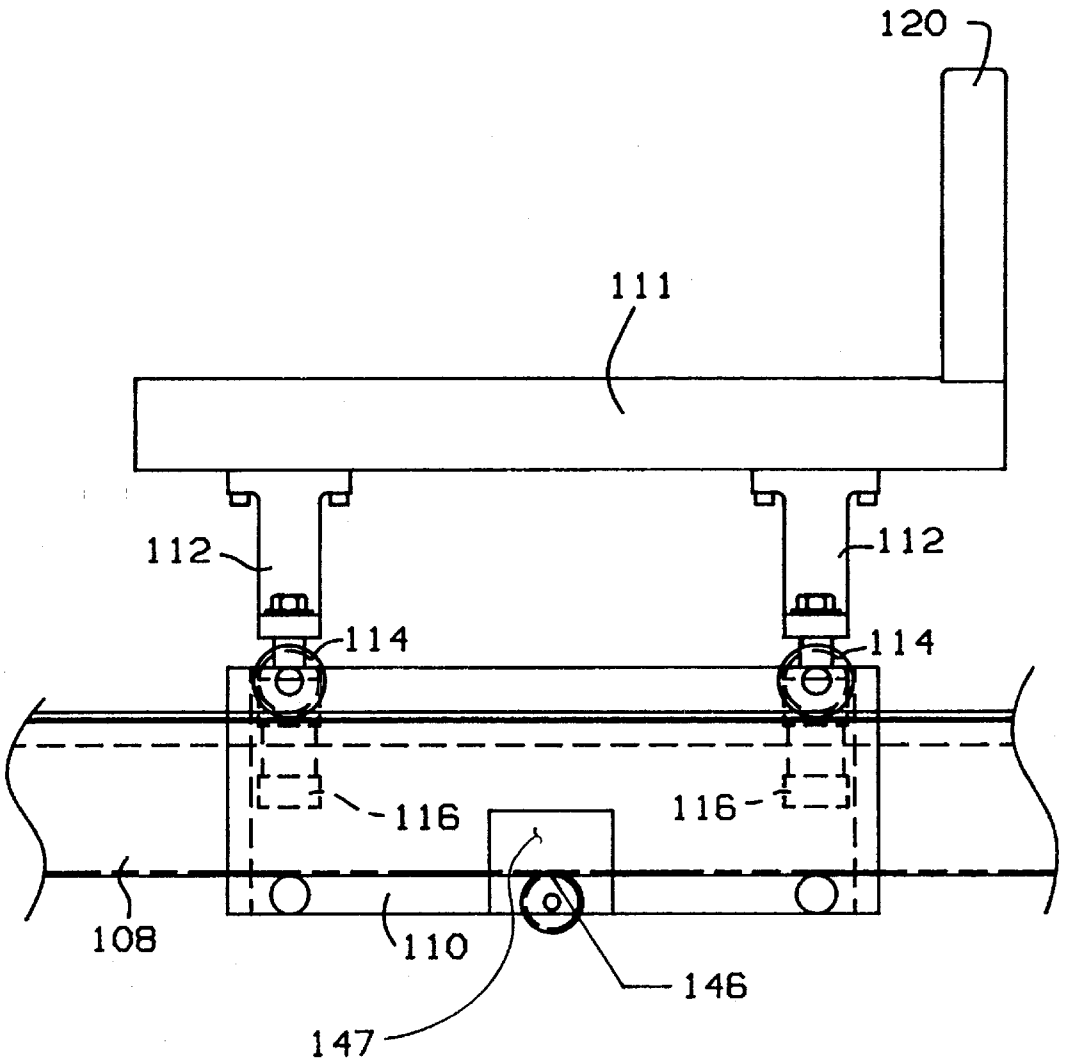
FIG. 8 shows a motor and gearbox assembly for powering the bundle transfer vehicle.

FIG. 8 shows a motor and gearbox assembly 147 mounted on the lower portion of bundle transfer vehicle 110. It drives output shaft and driver assembly 146 which cooperates with rail 108. This may be a rack and pinion type arrangement or it may be a wheel and surface drive based on friction. Shaft and driver assembly 146 may include a clutch device that is actuated such that when the clutch is engaged the bundle transfer vehicle may be driven in either direction and when the clutch is disengaged, the bundle transfer vehicle is free to move along the rails by the application of hand pressure by an operator.

Figure 9:
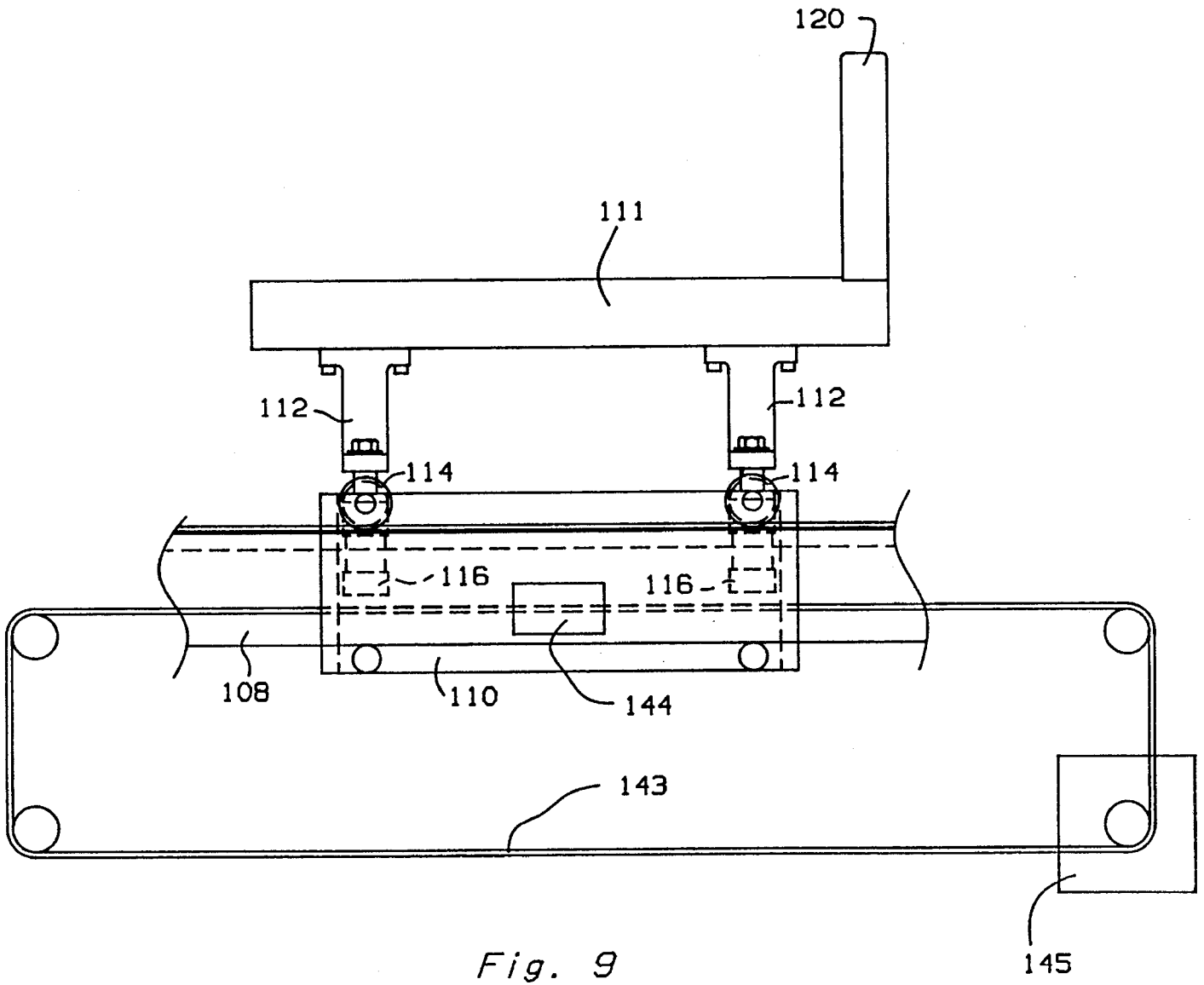
FIG. 9 shows a drive belt driven by a motor and gearbox assembly for powering the bundle transfer vehicle.

FIG. 9 shows a drive belt 143 such as a timing belt driven by motor/gearbox assembly 145. Clamping device assembly 144 can engage or disengage, that is clamp or unclamp from the timing belt such that when the clamp is engaged, the bundle transfer vehicle may be driven in either direction and when the clamp is disengaged, the bundle transfer vehicle is free to move along the rails by the application of hand pressure by an operator.

Figure 10:
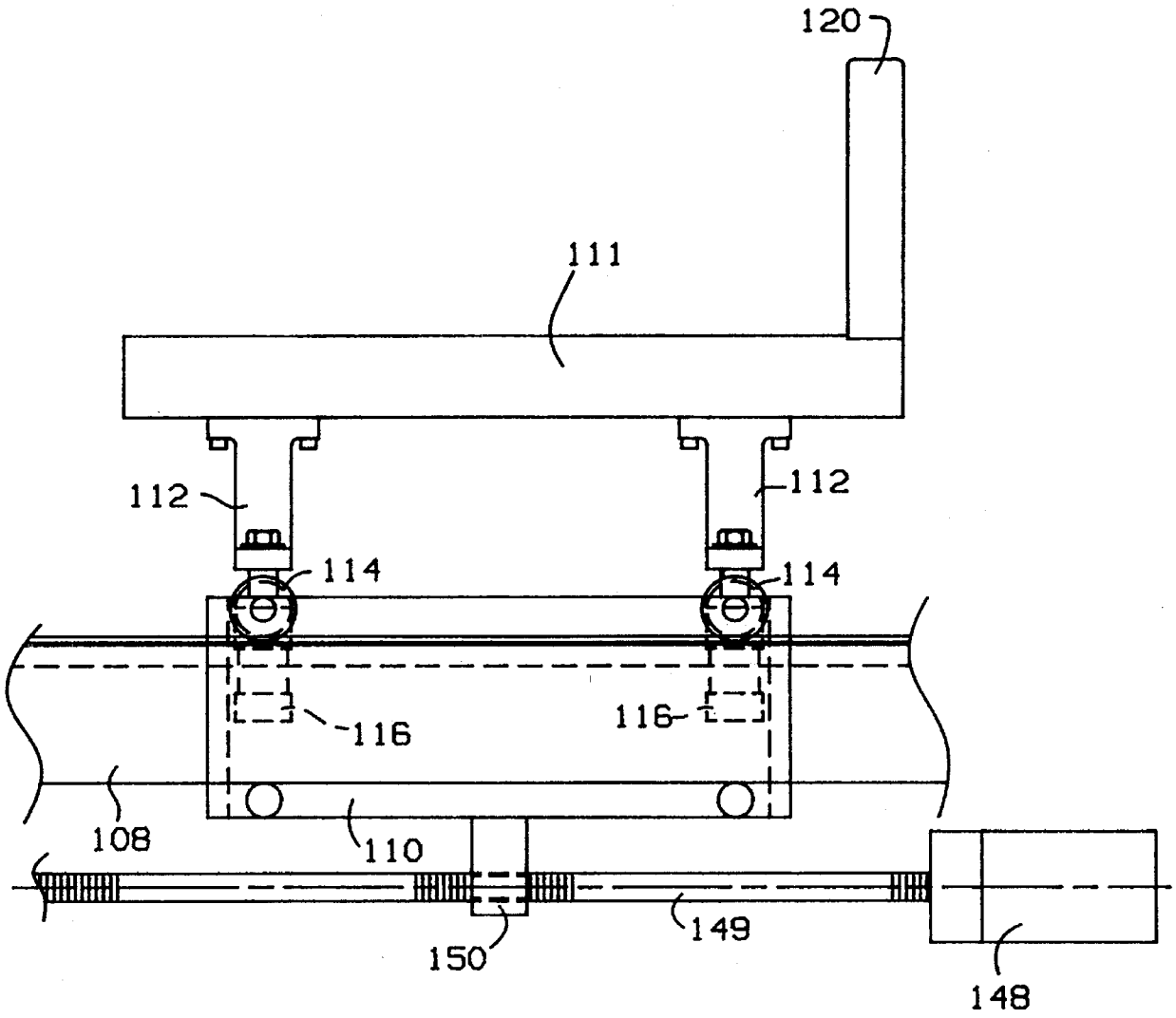
FIG. 10 shows a motor, gearbox and clutch assembly which drives a screw for powering the bundle transfer vehicle.

FIG. 10 shows a motor/gearbox/clutch assembly 148 which drives a screw or ball screw 149. The engageable/disengageable nut assembly 150 cooperates with screw 149 and is connected to the bundle transfer vehicle 110. When the nut is engaged, the bundle transfer vehicle may be driven in either direction and when the nut is disengaged, the bundle transfer vehicle is free to move along the rails by the application of hand pressure by an operator. The clutch in the motor/gearbox/clutch assembly 148 may also be used to control the powered transferred to the bundle transfer vehicle 110.

While the invention has been shown and described with reference to a preferred embodiments it is not to be considered limited thereby, but only construed in accordance with the following claims.

What is claimed is:

1. An apparatus for transferring sheet material in signature form comprising:

(a) a horizontal frame;

(b) a conveyor mounted longitudinally in the frame at an upper portion of a rearward section thereof and extending a part of the distance along the length of the frame, the conveyor comprising a plurality of horizontally disposed conveyor belts which are spaced apart to form gaps therebetween and which receive the sheet material in the form of a stack of signatures on top of the belts;

(c) one or more stationary rails mounted in the frame extending about parallel to the conveyor belts; the rails extending from the rearward section of the frame to a forward section of the frame;

(d) a bundle transfer vehicle having a first rolling element portion comprising a framework and a plurality of friction reducing means mounted on the framework, which friction reducing means engages and rides horizontally on the rails; and a second portion on the first portion comprising a plurality of connected, upright support segments and raising and lowering means mounted on the first portion capable of raising and lowering the support segments relative to the friction reducing means; the support segments being interdigitated and substantially aligned with the gaps between the conveyor belts, the segments being at a first position below the conveyor belts when the support segments are lowered by the raising and lowering means, and at a second position above the conveyor belts when the support segments are raised by the raising and lowering means, wherein at the second position the support segments are capable of lifting and holding the stacked sheet material in signature form away from the conveyor.

2. The apparatus of claim 1 further comprising means for biasing the bundle transfer vehicle for movement in at least one direction along the rails.

3. The apparatus of claim 1 wherein the stationary rails are mounted in the frame at a level lower than the top of the conveyor belts.

4. The apparatus of claim 1 wherein the rails underlie the conveyor at the rearward section of the frame.

5. The apparatus of claim 1 wherein the friction reducing means comprises a plurality of wheels.

6. The apparatus of claim 1 wherein the means for raising and lowering the support segments relative to the friction reducing means are connected between the support segments and friction reducing means.

7. The apparatus of claim 1 wherein the means for raising and lowering the support segments relative to the friction reducing means are air cylinders.

8. The apparatus of claim 7 wherein the air cylinders are connected between the support segments and friction reducing means.

9. The apparatus of claim 1 wherein the support segments comprise a plurality of upwardly projecting elements.

10. The apparatus of claim 9 wherein the support segments comprise said plurality of upwardly projecting elements each attached on one end to an air cylinder and on another end to one of a plurality of horizontal support members, which horizontal support members are spaced apart and align with the gaps between the conveyors belts.

11. The apparatus of claim 1 wherein the bundle transfer vehicle further comprises a backstop attached to the horizontal support members which are interdigitated and aligned with the gaps between the belts, which backstop is capable of supporting the sheet material in a vertical position.

12. The apparatus of claim 1 wherein the bundle transfer vehicle further comprises at least one guide means which stabilizes the bundle transfer vehicle and keeps it aligned along the rails.

13. The apparatus of claim 1 further comprising a rail mounted longitudinally on the frame at a level above that of the conveyor belts and extending from the rearward section of the frame along the length thereof; a rigid, pivotable product support mounted for transverse movement along the rail which provides a directed force support on the sheet material and maintains it in a substantially vertical position.

14. The apparatus of claim 1 further comprising a table positioned forward of the conveyor belts comprising a plurality of horizontally disposed rollers which are spaced apart to form gaps therebetween and which are capable of receiving the sheet material in the form of a stack of signatures on top of the table, each roller being aligned with one of said conveyor belts and allow the passage of the support segments interdigitated therebetween which support segments are aligned with the gaps between the rollers.

15. The apparatus of claim 14 further comprising at least one vertically positioned idler roller located at a forward section of the table and being capable of guiding the sheet material in the form of a stack of signatures off the top of the table.

16. The apparatus of claim 14 further comprising a plurality of horizontally positioned driven rollers located adjacent to the table and being capable of applying a force directing the sheet material in the form of a stack of signatures off the top of the table.

17. The apparatus of claim 16 further comprising powered clamping means for aligning the sheet material in the form of a stack of signatures while on the plurality of horizontally positioned driven rollers.

18. The apparatus of claim 17 further comprising powered compression means capable of compressing the sheet material in the form of a stack of signatures while on the plurality of horizontally positioned driven rollers.

19. The apparatus of claim 18 further comprising powered strapping means for providing a strap around the sheet material in the form of a stack of signatures while on the plurality of horizontally positioned driven rollers.

20. The apparatus of claim 19 further comprising an exit conveyor capable of moving the sheet material in the form of a stack of signatures away from the plurality of horizontally positioned driven rollers.

21. The apparatus of claim 1 further comprising a stacker attached to the horizontal frame adjacent to the conveyor.

22. The apparatus of claim 1 further comprising a table positioned forward of the conveyor belts comprising a plurality of horizontally disposed rollers which are spaced apart to form gaps therebetween and which are capable of receiving the sheet material in the form of a stack of signatures on top of the table, each roller being aligned with one of said conveyor belts and allow the passage of the support segments interdigitated therebetween which support segments are aligned with the gaps between the rollers; and wherein the support segments comprise a plurality of upwardly projecting members attached on one end to the raising and lowering means and on another end to one of a plurality of horizontal support members, which horizontal support members are spaced apart and align with the gaps between the conveyors belts and the table rollers; and wherein the bundle transfer vehicle further comprises a backstop attached to the support segments which are interdigitated and aligned with the gaps between the belts, which backstop is capable of supporting the sheet material in a vertical position; wherein the bundle transfer vehicle further comprises at least one guide means which stabilizes the bundle transfer vehicle and keeps it aligned along the rails; a rail mounted longitudinally on the frame at a level above that of the conveyor belts and extending from the rearward section of the frame along the length thereof and a rigid, pivotable product support mounted for transverse movement along the rail which provides a directed force support on the sheet material and maintains it in a vertical position.

23. The apparatus of claim 22 further comprising at least one vertically positioned idler roller located at a forward section of the table and being capable of guiding the sheet material in the form of a stack of signatures off the top of the table; and a plurality of horizontally positioned driven rollers located adjacent to the table and being capable of applying a force directing the sheet material in the form of a stack of signatures off the top of the table; and powered clamping means for aligning the sheet material in the form of a stack of signatures while on the plurality of horizontally positioned driven rollers; and powered compression means capable of compressing the sheet material in the form of a stack of signatures while on the plurality of horizontally positioned driven rollers; and powered strapping means for providing a strap around the sheet material in the form of a stack of signatures while on the plurality of horizontally positioned driven rollers; and an exit conveyor capable of moving the sheet material in the form of a stack of signatures away from the plurality of horizontally positioned driven rollers.

24. The apparatus of claim 23 further comprising a stacker attached to the horizontal frame adjacent to the conveyor.

25. The apparatus of claim 1 further comprising means to drive the bundle transfer vehicle along the stationary rails.

26. The apparatus of claim 25 wherein the means to drive the bundle transfer vehicle along the stationary rails is selected from the group consisting of a combination of a driven timing belt and means for clamping the bundle transfer vehicle to the belt, an air cylinder, a screw drive, and a motor mounted on the bundle transfer vehicle which engages the rails.

27. The apparatus of claim 25 further comprising clutch means for selectively engaging and disengaging the means to drive the bundle transfer vehicle along the stationary rails.

* * * * *